United States Patent [19]

Foncannon

[11] 4,072,286

[45] Feb. 7, 1978

[54] GARBAGE CAN SUPPORT

[76] Inventor: William S. Foncannon, P.O. Box 123, Mullinville, Kans. 67109

[21] Appl. No.: 724,737

[22] Filed: Sept. 17, 1976

Related U.S. Application Data

[63] Continuation-in-part of Ser. No. 622,772, Oct. 15, 1975, abandoned.

[51] Int. Cl.[2] ..... A47G 23/02

[52] U.S. Cl. ..... 248/154; 248/156; 248/DIG. 7; 248/188.7

[58] Field of Search ..... 248/154, 151, 188.7, 248/156, DIG. 7; 24/270, 271

[56] References Cited

U.S. PATENT DOCUMENTS

| | | | |
|---|---|---|---|
| 2,302,475 | 11/1942 | Richards | 24/271 |
| 2,305,994 | 12/1942 | Richards | 24/271 |
| 2,513,461 | 7/1950 | Duncan | 248/154 |
| 2,513,631 | 7/1950 | Erickson | 248/154 |
| 2,579,975 | 12/1951 | Scott et al. | 220/61 |
| 3,021,960 | 2/1962 | Pipe | 248/188.7 |
| 3,062,503 | 11/1967 | Borrow | 254/79 |
| 3,178,142 | 4/1965 | Koch | 248/DIG. 7 |
| 3,239,175 | 3/1966 | Seibel | 248/154 |
| 3,370,864 | 2/1968 | Burgoon | 280/79.2 |
| 3,802,717 | 4/1974 | Eitreim | 248/DIG. 7 |

*Primary Examiner*—Robert A. Hafer

*Attorney, Agent, or Firm*—Fishburn, Gold & Litman

[57] ABSTRACT

A support for containers such as cans for garbage, trash and the like, comprising a base, a band attached thereto, and a quick release, locking mechanism operably connected to the band for manipulatng the same. The locking mechanism tightens and loosens the band about the container which is disposed on the base, thereby releasably fastening the trash or garbage can to the base. The base is attached to the floor of a building or to the ground in closely spaced relation thereto to prevent the inadvertent upsetting of the can, and requires a minimum of lifting for removal of the trash can. The band is circumferentially adjustable and slideably connected with the base for supporting and securing variously sized cans with stops or keepers to prevent accidental separation of the parts thereof.

3 Claims, 8 Drawing Figures

GARBAGE CAN SUPPORT

This application is a continuation-in-part of my pending United States patent application Ser. No. 622,772, filed Oct. 15, 1975, now abandoned.

This invention relates to supports for containers such as cans for garbage, trash and the like, and more particularly to supports which selectively, releasably and lockingly engage portions of said containers.

Garbage cans are inevitably placed outside the building for some period of time such as when they are stored next to a building or in an alley adjacent thereto, thereby exposing the cans to elements which may cause them to be overturned. Even if the garbage cans are not permanently stored outside, most sanitation departments condition the collection of garbage upon the owners transporting the same to the street or driveway by an appointed hour and day. Since the garbage collectors are not always punctual and because their schedule sometimes varies, as with holidays, and the like, the cans can be exposed to upsetting elements for substantial periods of time. Small animals, such as dogs, cats and raccoons are attracted to the garbage in the cans and frequently overturn them in an effort to gain access to their contents. Also, high winds, storms and other inclement weather conditions, as well as human acts can cause the cans to be upset. The upsetting of a garbage can typically causes the trash and garbage to be strewn about the adjacent areas, and it is a most tedious and unpleasant task to retrieve the unsightly refuse and replace it into the can.

Supports have been used for holding containers, particularly for trash and garbage cans, and for securing the container relative to a stable and convenient surface. Such supports have walls or the like, forming a deep pocket in which the cans are placed, thereby requiring substantial lifting of the supported can over the walls. Other supports have threaded clamps and the like which are time consuming and difficult to operate in securing a can in place and removing the same for emptying.

The principal objects of the present invention are: to provide a support for containers which securely and releasably engages the container to overcome the aforementioned difficulties; to provide such a structure wherein the support is fixed in a selected location with a base in closely spaced relation to the ground and cans are removably retained thereon as by a band-like member supported by said base; to provide such a structure wherein a quick release, toggled, locking mechanism is operably connected to the band for quickly, easily and securely engaging the container; to provide such a structure wherein a toggle arm is pivotally attached to one end of the band and rotation thereof causes the ends of the band to converge and engage a portion of the can; to provide such a structure wherein said band is circumferentially adjustable to accomodate variously sized containers; to provide such an adjustable structure with stops or keepers to prevent accidental separation of parts thereof; to provide such a structure wherein means are provided for selectively locking the toggle arm in a closed position; to provide such a structure wherein the base has a plurality of radially extending arms and clips slideably connected therewith for supporting the band; to provide a structure wherein the band and clips engage the garbage can at such a height that there is no increased difficulty in moving the can when it is full; to provide such a structure wherein the band is resilient to facilitate the easy disengagement of said band; to provide such a structure wherein selected rotation of a toggle arm causes the ends of the band to converge to a closed position about the can such that the resiliency of the band urgingly retains the toggle arm in a locked position; and to provide such a support which is economical to manufacture, efficient in use and capable of long operating life and particularly well adapted for the proposed use.

Other objects and advantages of this invention will become apparent from the following description taken in connection with the accompanying drawings wherein are set forth by way of illustration and example, certain embodiments of this invention.

The drawings constitute a part of this specification and include exemplary embodiments of the present invention and illustrate various objects and features of the apparatus.

Figure 1:
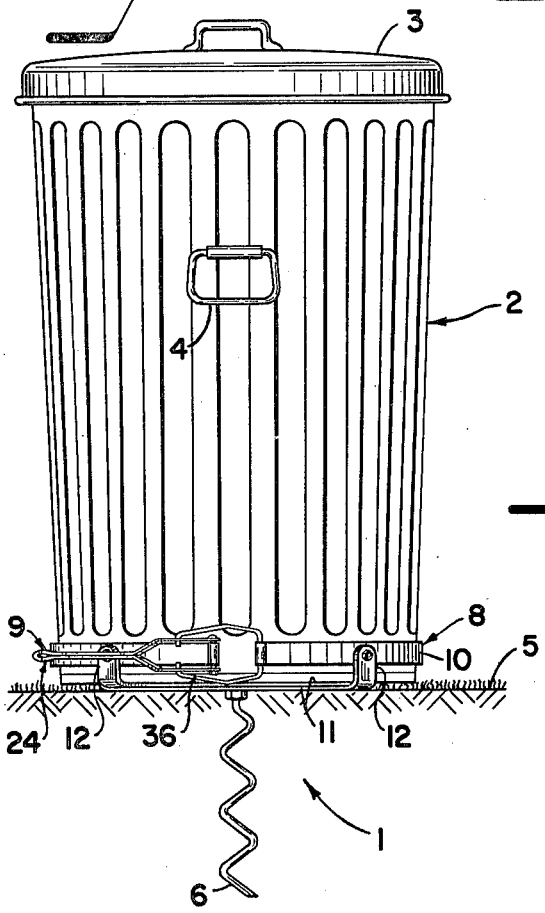
FIG. 1 is a side elevational view of a support embodying the present invention shown installed in the ground with a garbage can engaged therein.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference numeral 1 generally designates a holder or support for containers such as garbage can 2 and the like, having a lid 3 and carrying handles 4. The support 1 is attached to a surface such as the ground 5 by means such as a helical ground screw 6 or an auger 7 near a drive or at any convenient and suitable place for trash collection. The garbage can 2 is set into a base member 8 and a quick release mechanism 9 operably attached to a clamping means is manipulated so as to tighteningly and securely engage the band about a lower portion of the can and lockingly maintain said engagement. The support 1 removably supports the lower portion of can 2 in a closely spaced relation to the ground level, such that only slight vertical movement of the can is required to separate the two members. Upon his arrival, the garbage collector manipulates the mechanism 9 in a reverse fashion thereby easily and quickly releasing the can from the support and empties the can and returns it to the support.

The garbage can support structure includes a base 8 comprising a plurality of radially extending arms 11 having circumferentially spaced outer end portions 12. The base 8 is generally horizontally disposed on the ground 5 and the end portions 12 are disposed perpendicularly and upwardly of said arms. In the structure illustrated, there are four arms, two pairs of which are integral and coincident having vertical co-operating apertures 13 in the center thereof for receiving anchor means for attaching the base 8 to the ground 5. The upstanding end portions 12 of the base are provided with apertures 14, for receiving means for fastening the band 8 thereto.

Figure 2:
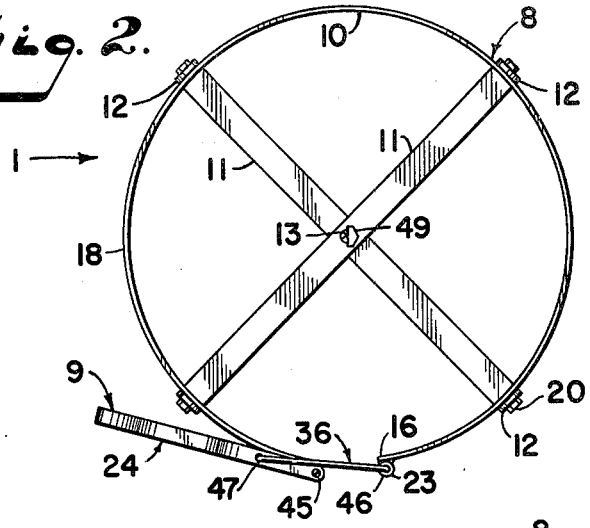
FIG. 2 is an enlarged top plan view of the garbage can support in a closed, locked position.

The band 10 is a resilient and elongated structure operably connected to the base 8 and engages a portion of the can 2 for attaching the base thereto. In the structure illustrated, the band is substantially arcuate in shape, having two circumferentially disposed end portions 15 and 16, and a plurality of co-operating apertures 17 disposed about the transverse midportion thereof which mate with apertures 14 in the end portions 12 of the arms. The band is preferably disposed radially inwardly of the upstanding end portions 12, the outer curvilinear surface 18 of the band abutting the inward surface of the ends thereby forming a nearly continuous circular structure to engage the can 2. Fasteners, such as bolts 19, are disposed through apertures 14 and 17 and are secured therein with means such as nuts 20 for attaching the base to the band. The heads 21 of the bolts 19 are preferably recessed into the band, as shown in FIG. 2, so as not to interfere with band engagement. The ends of the band 15 and 16 are provided with pivot means thereon for attaching the toggle mechanism 9 thereto and as illustrated, includes tubular members or sleeves 22 and 23 attached transversely to the outer surface of the band at the ends 15 and 16 thereof respectively.

The locking mechanism 9 is operably connected to the band 10 and includes a lever or toggle arm 24, the manipulation of which tightens and loosens the band's engagement with a portion of the can. Means are provided on the support 1 for locking the toggle arm in a closed position wherein the can is securely but releasably attached to the support. In the structure illustrated, the toggle arm 24 is an elongated structure preferably formed of a rectangular bar having a handle portion 25 and an integral forked or U-shaped portion 26. The U-shaped portion has two parallel sides 27 and 28 spaced apart a distance substantially equal to the length of sleeve 22 and adapted for pivotal attachment thereto. A first pair of coaxial and cooperating apertures 29 and 30 are centrally and transversely disposed through toggle arm 24 adjacent to the ends of the sides 27 and 28 respectively. A pivot pin or elongated fastener 31 is disposed through apertures 29 and 30 and sleeve 22, thereby rotatably mounting the toggle arm 24 to the band 10 and defining a first pivot point 45. A second pair of coaxial apertures 32 and 33 are centrally and transversely disposed through sides 27 and 28 of the toggle arm a predetermined distance from the ends 34 and 35 thereof for co-operating, pivotal engagement with portions of the link members 36. The handle portion 25 of the toggle arm 24 extends longitudinally and centrally of the U-shaped portion, having sides 37 and 38 which, as illustrated, are formed by the convergence of sides 27 and 28, are integral therewith, and are abuttingly attached with a looped end portion 39. The handle portion 25 is adapted for rotational manipulation of the toggle arm by the user, such as being grasped by the user's hand, or engaged by the user's foot.

The link member 36 is a structure having a first portion pivotally attached to one end 16 of the band and a second portion pivotally attached to the toggle arm 24 for operably transmitting toggle arm rotation to the band. In the structure illustrated, the link member is elongated and preferably formed of a circular rod having a linear mid portion 40 which is rotatably disposed and retained in sleeve 23 thereby defining a second pivot point 46. A pair of axially coplanar arm members 41 and 42 extend opposingly, arcuately from the mid portion 40 in the same direction, and terminate in inwardly facing, substantially coaxial ends 43 and 44 which are linear and substantially parallel to the mid portion. The ends 43 and 44 are rotatably disposed in apertures 32 and 33, pivotally attach the link member 36 and the toggle arm 24, and defining a third pivot point 47. The ends 43 and 44 are retained in apertures 32 and 33 by means such as snap rings (not shown) or, as illustrated, slight inward deformation thereof.

Figure 3:
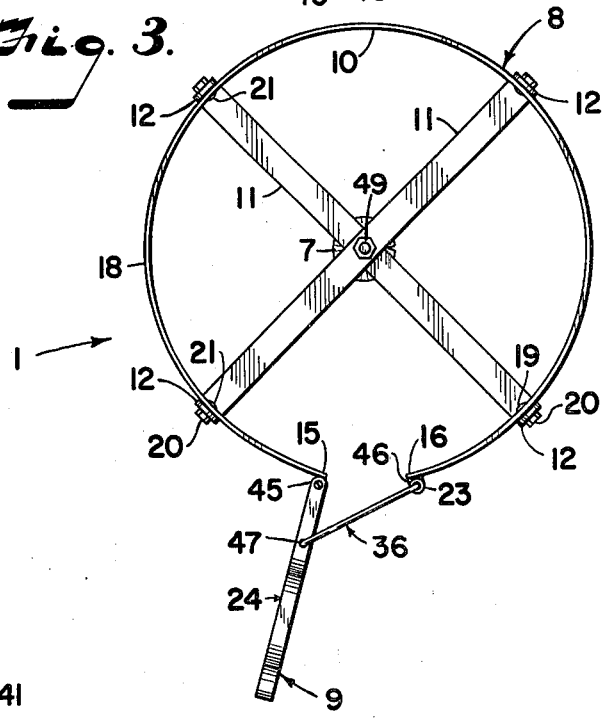
FIG. 3 is an enlarged top plan view of the garbage can support in an open, released position.
Figure 4:
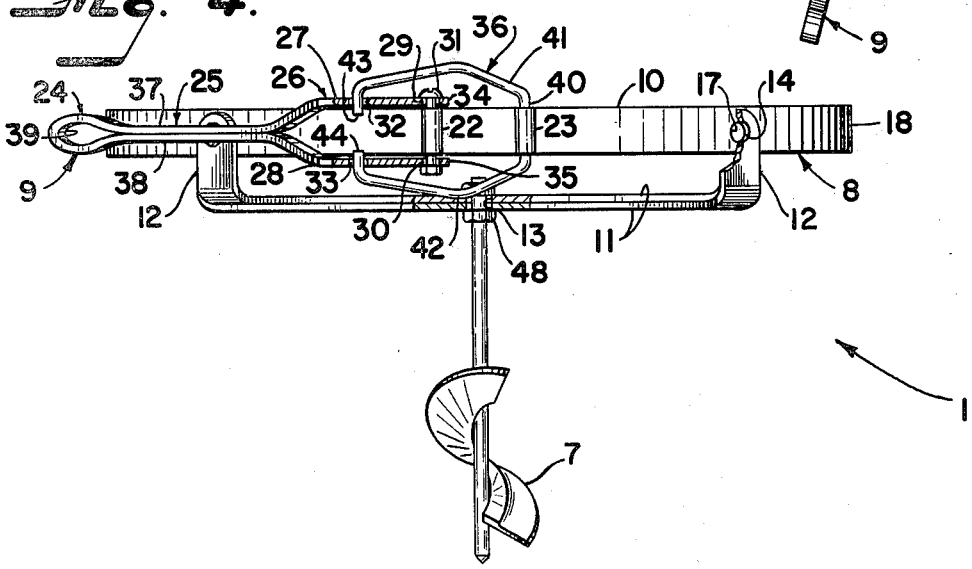
FIG. 4 is a further enlarged side elevational view of the garbage can support with ground attachment means disposed therein.
Figure 5:
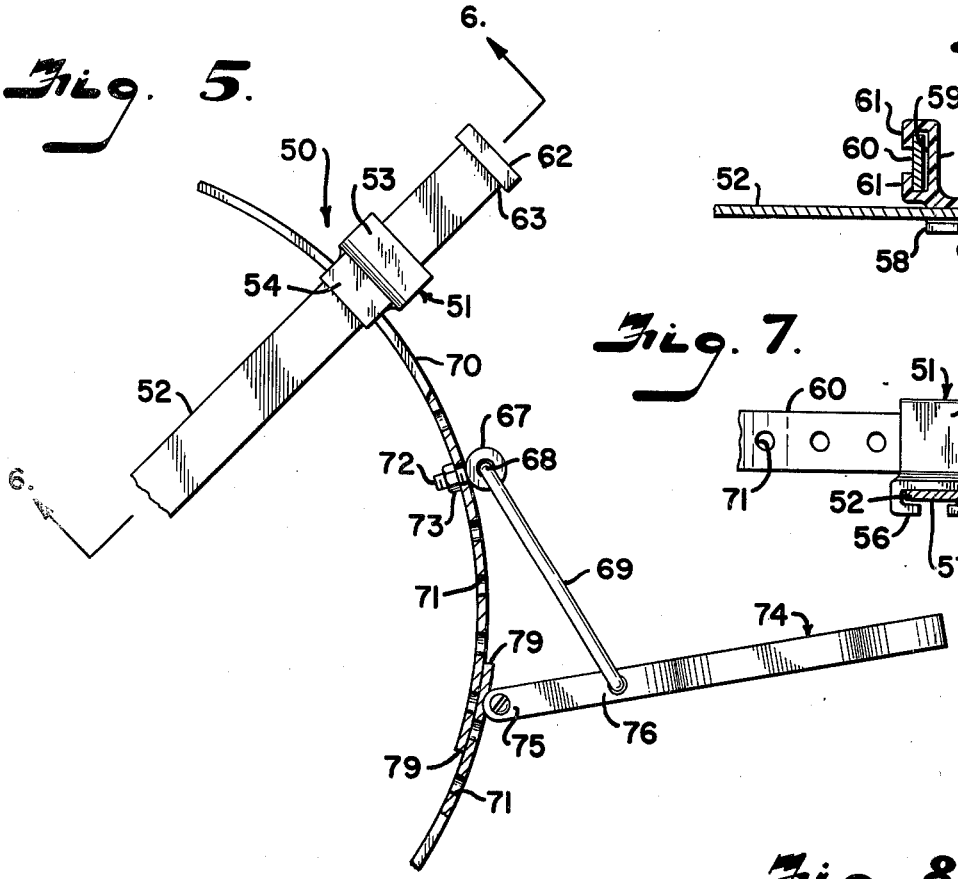
FIG. 5 is a fragmentary, top plan elevational view of another embodiment of the support having a circumferentially adjustable band.
Figure 6:
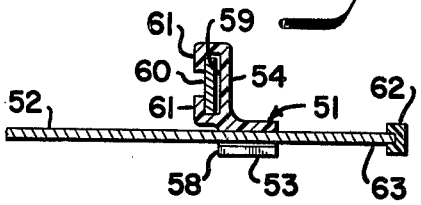
FIG. 6 is a fragmentary, vertical cross-sectional view of the adjustable support, taken along line 6—6, FIG. 5.
Figure 7:
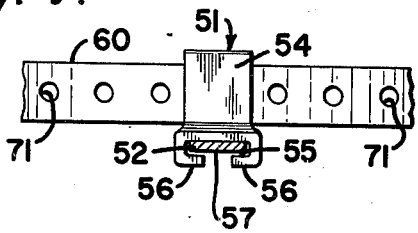
FIG. 7 is a fragmentary side elevational view of the adjustable support.
Figure 8:
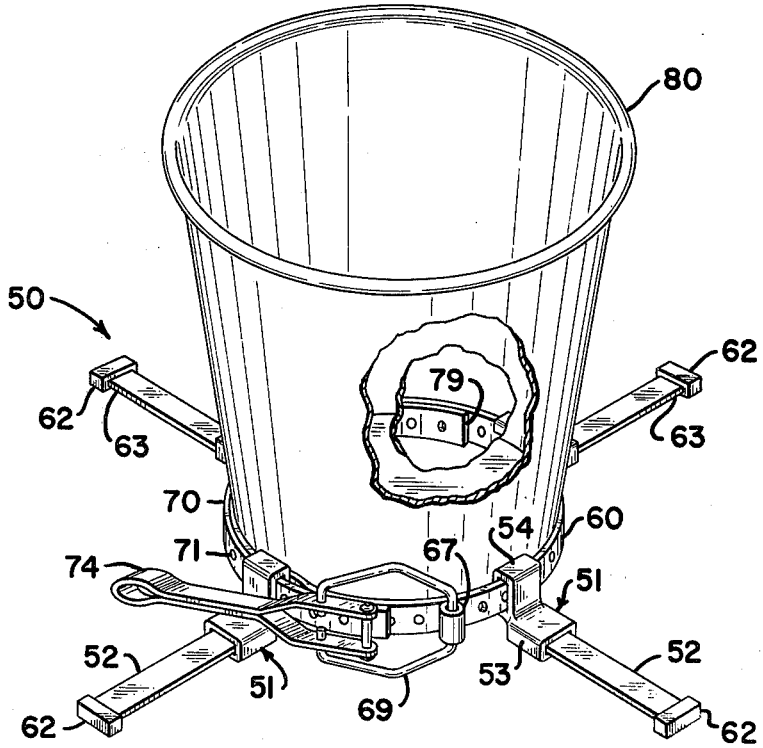
FIG. 8 is a top plan view of the support with a container having a circumferentially smaller base engaged therein.

In use, the illustrated garbage can support 1 operates in the following manner: One end of the helical screw 6 or the auger 7 is positioned through the aperture 13 and attached to the base 8 by means such as nuts 48. The other end of the screw is engaged in the ground 5. If the support is to be installed on a hard surface such as concrete or asphalt, means such as an anchor (not shown) are employed with bolt 49 (FIG. 2) to attach the support to the surface. The container such as garbage can 2 is set on the base 8 of the support 1, which is an opened or released position (FIG. 3) with the toggle arm 24 extending outwardly. The operator then rotates the toggle arm 24 inwardly and away from the link member 36, such as by grasping the handle 25 with his hand, or engaging the same with his foot, as illustrated, in a clockwise fashion. Said rotation causes the first and second pivot points 45 and 46 to converge thus drawing the resilient band tightly about the lower periphery of the can 2, maximum convergence occurring at the point where the first, second and third pivot points 45, 46 and 47 respectively, are colinear. Continued rotation in the same direction causes the third pivot point to translate radially inwardly of a line connecting first and second pivot points, the toggle arm abuttingly engages a portion of the band which prevents further rotation thereof, and the resiliency of the band maintains said engagement, thus lockingly retaining the toggle arm 24 in the closed or locked position (FIG. 2). To release the can from the support, such as by the garbagecollector to empty the can, the toggle arm 24 is simply manipulated in a reverse fashion, the resiliency of the band causing the support of automatically assume a fully open or released position after the toggle mechanism is unlocked.

The reference numeral 50 generally designates a modified form of the present invention and includes a plurality of clips 51 each being slidably connected with a different one of the radially extending arms 52 for circumferentially adjusting the band to accomodate variously sized containers. The clip 51 comprises a base portion 53 and a leg portion 54 upstanding therefrom and connecting therewith. The clip base 53 is elongate to resist twisting from forces applied thereto by the band, and includes a C-shaped channel disposed longitudinally therethrough for cooperating, sliding contact with the base arms 52. The channel 55 includes a pair of opposed, inwardly extending flanges 56 for engagement with the lower surface 57 of the arms to prevent inadvertent separation therefrom. The shape of the channel 55 is such that clearance is provided about the peripheral surfaces thereof for improved longitudinal translation. The leg portion 54 of the clip is connected at the radially forward end 58 of the base, includes a C-shaped channel disposed perpendicularly of the base channel 55, and slidingly retains therein the band 60. In a manner similar to the base channel 55, the leg channel 59 includes a pair of opposing and inwardly extending flanges 61 which slidingly retain the band therein. The shape of the leg channel 59 is such that clearance exists between the clip and the band for smooth and easy translation therebetween. The clip 51 is preferably constructed of a synthetic resin material such as nylon or the like, which is substantially impervious to corrosion, and which is self-lubricating to reduce frictional sliding forces. In the illustrated structure, a keeper or stop member 62 is connected with the radially outward end 63 of each arm and prevents the clip from sliding off of the arm when the support is in an expanded or disengaged condition with the container. The stop members 62 each have a portion thereof which is enlarged with respect to the base channel 55 and engages the outwardly end of the base to prevent the separation of the parts. In this example, the stop members have a rectangular shape with an aperture disposed in the radially inward portion thereof. The aperture receives the end 63 of the arm 52 therein, and the stop member is thereby securely connected with the support by suitable means such as a retainer, adhesive or a snap fit.

The sleeve member 67 in which the closed end portion 68 of the link member 69 is pivotally mounted, is separably attached to the band 60 about the outer circumferential surface 70 thereof. In the illustrated structure, a plurality of apertures 71 are disposed radially through the band in a spaced circumferential fashion. The sleeve 67 is in the form of a tubular segment having a stud with a threaded end 72 and a cooperating nut 73 engaged therewith. By removing the nut 73, the sleeve 67 may be positioned in any one of the severeal apertures 71. A toggle arm 74 is rotatably mounted at one end 75 thereof to the band 60 and is pivotally connected at a medial portion 76 thereof to the other end of the link member 69.

In use, the container support 50 is circumferentially adjustable to accomodate the support of variously sized containers. To reduce the size of the engaging members of the support for abutting contact with a smaller container, the ends 79 of the bands are pulled overlapping each other, and the clips 51 are thereby simultaneously translated inwardly on the radial arms 52, with the band sliding through the leg channel 55. The band is thusly adjusted until the clips 51 and band 60 nearly engage the container 80. The sleeve 67 is then connected through the appropriate aperture 71 and attached to the band 60, by tightening nut 73. By rotating the toggle arm 74, the band is further constricted and firmly grips the container disposed within the support. To increase the size of the container support, the above described process is simply reversed.

It is to be understood that while I have illustrated and described certain forms of my invention, it is not to be limited to the specific forms or arrangement of parts herein described and shown.

What I claim and desire to secure by Letters Patent is:

1. A garbage can support comprising:

a. a generally horizontally disposed base having a plurality of radially extending, substantially flat arms with circumferentially spaced outer ends;

b. a plurality of clips each having a base and an upstanding leg attached thereto; each of said clip bases being elongate, and having a downwardly disposed C-shaped channel wherein a different one of said arms is positioned for sliding, longitudinal translation thereon; each of said clip legs having a transverse opening therethrough;

c. a normally arcuate band member positioned slidably within each of the openings of said legs for connection therewith; said band member being supported above said arms by said clips whereby said elongate clip base resists twisting from forces applied thereto by said band; said band having spaced ends between adjacent arms;

d. a quick release locking mechanism operably connecting said band ends and including:

1. a toggle arm pivotally connected with one end of said band and disposed for operation in a horizontal plane;

2. a first sleeve having a transversely disposed aperture therethrough and being separably connected with the other end of said band;

3. a link member having a first portion thereof positioned within said sleeve aperture and being pivotally connected with said first sleeve; a second portion of said link member being pivotally connected with said toggle arm whereby selected rotation of said toggle arm causes the ends of said band to converge to a closed position, wherein said clips and said band are clamped abuttingly about a lower portion of said container and said toggle arm engages a portion of said band to maintain said closed position; and e. means separably connecting said first sleeve with said band other end at circumferentially spaced positions thereon to accomodate variously sized containers, and including:

1. a plurality of radially disposed and circumferentially spaced apertures through said band and positioned adjacent to said other end thereof; and 2. a rod attached radially to said first sleeve and disposed within one of said band apertures, said rod having a threaded free end and a nut engaged therewith for separably connecting said band and first sleeve.

2. A support as set forth in claim 1 wherein:

a. each of said clips is constructed of a synthetic resin material for smooth translation on said arms.

3. A support as set forth in claim 1 including:

a. a plurality of stop members each being connected with a different one of said arms at the outer end thereof; said stop members each having an enlarged portion thereof engaging a portion of said clip when said support is in a fully expanded condition to prevent separation of said clip from the arm on which said clip is slidably connected.

* * * * *